United States Patent [19]

Zinnbauer

[11] Patent Number: 4,998,988

[45] Date of Patent: Mar. 12, 1991

[54] TAMPER EVIDENCING CAP AND CONTAINER

[75] Inventor: Gerald Zinnbauer, Charlotte, N.C.

[73] Assignee: Kardon Industries, Inc., Philadelphia, Pa.

[21] Appl. No.: 409,827

[22] Filed: Sep. 20, 1989

[51] Int. Cl.[5] ..... B65D 41/34

[52] U.S. Cl. ..... 215/230; 215/250

[58] Field of Search ..... 215/230, 365, 250, 253, 215/209, 213, 221; 222/519, 541

[56] References Cited

U.S. PATENT DOCUMENTS

| | | | |
|---|---|---|---|
| 3,463,341 | 8/1969 | Fields | 222/541 X |
| 3,743,127 | 7/1973 | Morceau | 215/221 |
| 3,826,221 | 7/1974 | Ross | 215/230 X |
| 3,957,169 | 5/1976 | Coursaut | 215/253 |
| 4,106,651 | 8/1978 | Lemons | 215/221 |
| 4,153,174 | 5/1979 | Keeler | 215/250 |
| 4,573,601 | 3/1986 | Berglund | 215/252 |
| 4,591,062 | 5/1986 | Sandhaus | 215/230 |
| 4,678,083 | 7/1987 | Anderson | 215/230 X |
| 4,685,578 | 8/1987 | Dunshee | 215/230 |
| 4,706,828 | 11/1987 | Zinnbauer | 215/246 |
| 4,722,451 | 2/1988 | Conrad | 215/365 |
| 4,771,923 | 9/1988 | Zinnbauer | 215/253 X |

FOREIGN PATENT DOCUMENTS

| | | | |
|---|---|---|---|
| 2431439 | 3/1980 | France | 215/221 |
| 855701 | 12/1960 | United Kingdom | 215/250 |

*Primary Examiner*—Stephen Marcus

*Attorney, Agent, or Firm*—Volpe and Koenig

[57] ABSTRACT

A tamper evident closure for an open container having an outwardly projecting container finish proximate to the container opening is disclosed. The closure comprises a hollow body which includes a tamper evidencing means. The tamper evidencing means is hinged within the body so that removal of the closure from the container requires engagement of the tamper evidencing means with the projecting finish. This engagement results in outward displacement of the tamper evidencing means and creates a visual impression.

21 Claims, 3 Drawing Sheets

TAMPER EVIDENCING CAP AND CONTAINER

BACKGROUND OF THE INVENTION

1. Field Of The Invention

This invention relates to tamper evidencing caps and containers which provide visual evidence of prior cap removal. More particularly, the present invention relates to a tamper evidencing cap and container with an automatic indicator which becomes visually apparent when the cap is removed for the first time.

2. Description Of The Related Art

A variety of tamper evidencing devices have been developed. Such devices are especially useful for containers that hold food or medicine. These devices generally seek to allow the consumer to visually determine container tampering prior to use. See for example, my own prior U.S. Pat. No. 4,771,923. Other examples of tamper evidencing means are shown in the following patents; U.S. Pat. Nos.: 3,673,761; 4,480,761; 4,506,795; 4,595,110; 4,595,547; 4,598,833; 4,591,062; 3,957,169; 1,875,431; 3,335,889; 4,573,601; UK Pat. No. 974,564; Italian Pat. No. 527065; and French Pat. No. 1,268,937

SUMMARY OF THE INVENTION

In general, the present invention relates to a closure for use with an open container having an outwardly projecting finish at the container opening. The closure is comprised of a hollow body having a closed end and an open end. Disposed within the hollow body is a tamper evidencing means which includes a hinged element. Removal of the closure from the container requires engagement or a contact of the hinged element with the projecting finish of the container. This contact causes the hinged element to be displaced outwardly. The outward displacement of the hinged element results in a visual indication that the cap has been removed or dislodged from it original secured position.

It is an object of the present invention to provide an improved tamper evidencing cap and container. It is another object of the present invention to provide a tamper evidencing cap which provides a visual indication of tampering. It is still another object of the present invention to provide a tamper evidencing cap which is capable of employing a visual tamper indicator in a variety of shapes.

It is yet another object of the present invention to provide a visual tamper indicator which is automatically apparent from the cap upon removal of the cap from the container. As noted previously, the present invention provides a tamper evidencing container closure in which an indicator becomes automatically visible on the body of the container cap upon removal of the cap from the container. Preferably, the cap includes an integral sealing means oriented on the interior surface of the top of the cap which provides for resealing of the container when the cap is on the container. Typically, the flexible sealing means contacts the container finish at the opening to reseal the container when the cap is secured on the container.

In the preferred embodiment, the indicator or tamper evidencing means includes a biasing portion activated by contact of the biasing portion with the container finish. The contact between the biasing portion and the container finish automatically pivots the indicator means outwardly from the cap and creates a visual indication that the cap has been tampered with and/or removed.

The indicator means may include a hinged portion with an elastic memory which maintains it in an outwardly projecting position. Alternatively, the biasing portion may permanently deform a cover member or activate a permanent indicator to evidence movement of the cap.

A DETAILED DESCRIPTION OF THE PREFERRED EMBODIMENT

Figure 1:
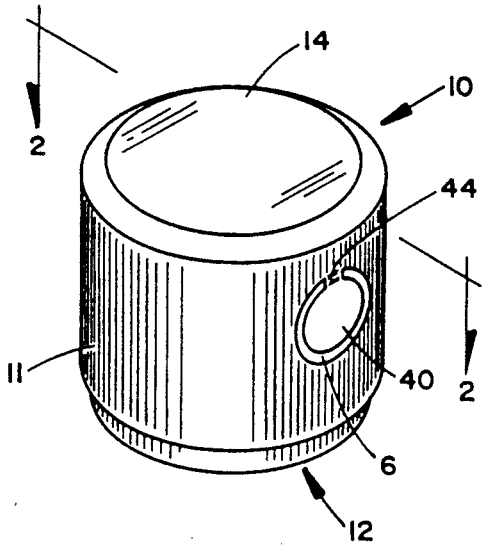
FIG. 1 is a perspective view of a tamper evidencing container closure in accordance with the present invention.

The present invention, in the preferred embodiment, is generally related to a tamper evidencing cap 10 for a bottle or container having an externally threaded neck. With reference to FIG. 2, the cap 10 includes a hollow, substantially tubular, body 11 with an open bottom 12 and a closed top 14. The interior wall 15 of cap 10 includes a female thread pattern 18 which engages a male thread pattern 19 on the container 2. Those skilled in the art will recognize that the container opening, including the neck shape and thread configuration, is generally referred to as the finish. As referred herein, finish will mean all surface features on or at the container opening, including any thread configuration designed to receive a closure. Whether or not the finish includes thread, it will always include at least one outwardly projecting finish portion 43.

Still with reference to FIG. 2, the top 14 of cap 10 has a flexible sealing means 30 depending from the interior surface 32. Flexible sealing means 30 can be formed integral with cap 10, as shown, or may comprise a separate sealing element. Contact of the flexible sealing means 30 with the top of container finish 13 deflects the sealing means 30 and seals the container opening.

Figure 2A:
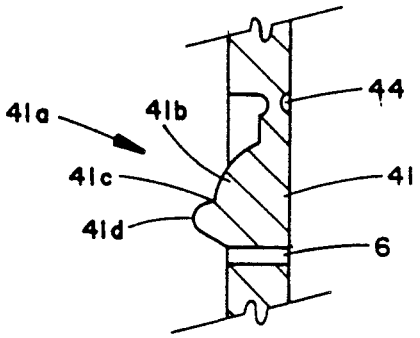
FIG. 2A is an exploded view of the section A from FIG. 2.
Figure 2:
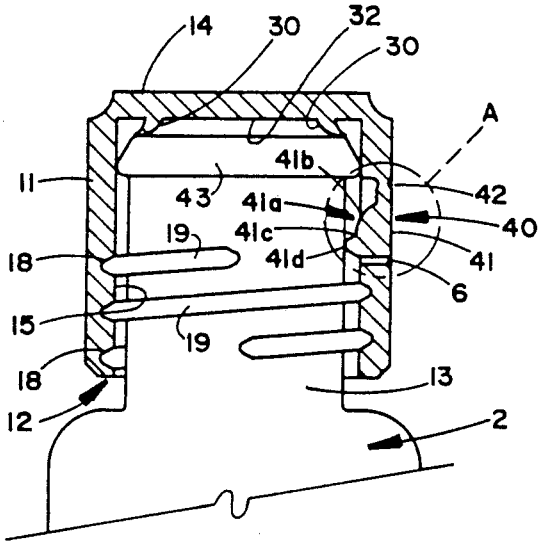
FIG. 2 is a cross-sectional side view of the container closure of FIG. along the line 2—2, oriented in a sealed position on a container.
Figure 3:
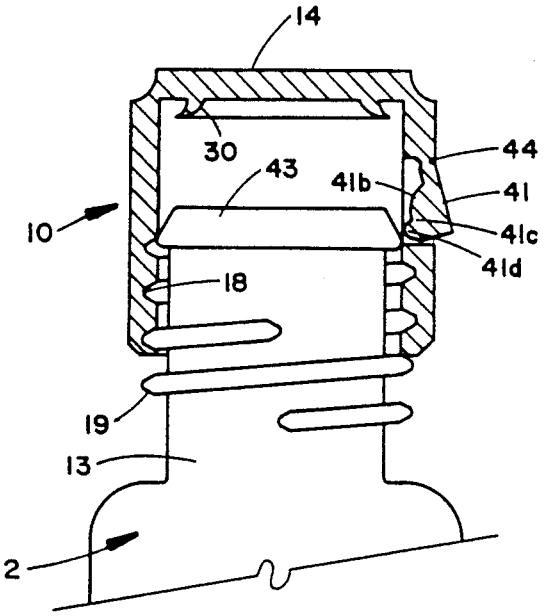
FIG. 3 is a cross-sectional side view of the container closure of FIG. 2 partially removed from the container.
Figure 4:
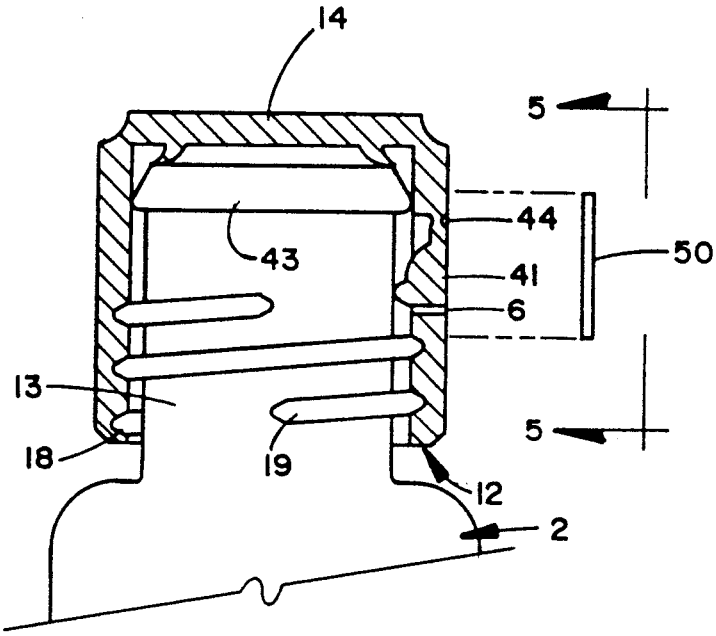
FIG. 4 is a cross section of the container closure of FIG. 1 showing the application of a sealing element in accordance with the present invention.

As can be seen by referring to FIG. 1, 2 and 3, a tamper evidencing or indicator means 40 is defined in the body 11 of cap 10. Tamper evidencing or indicator means 40 comprises a depending tag element 41 which is joined to the cap via hinge element 42. The tag 41 is slightly smaller than the surrounding aperture 6 in body 11 in order to provide a separation between the two and to permit clearance for the tag to move outwardly.

With reference to FIG. 2A further details of tag element 41 will be described in more detail. The interior of tag element 41 includes an interior cam surface 41*a*. The interior cam surface is comprised of a first arcuate portion 41*b* which terminates in a lip or ledge 41*c*. The union of portion 41*b* and portion 41*c* is just slightly interior to the plane of interior wall 15. Adjoining lip 41*c* is a convex portion 41*d*. Portions 41*c* and 41*d* are dimensioned so as to interfere with the outwardly projecting container finish element 43. Through the engagement of the interior camming surface 41*a* with the projecting finish element 43 tagged 41 is forced outwardly from the exterior surface of body 11.

As the cap of the preferred embodiment is unscrewed the interior cam surface 41*a* of indicator means 40 engages the outwardly projecting container finish element 43, this causes outward displacement of tag element 41 from its original position, FIG. 2, to its pivoted position, FIG. 3. As a result of the mechanical advantages of the threads, the lip 41*c* will cause a momentary build up of force on the tag 41. As the force increases, lip 41*c* will be overcome and the convex portion or projection 41*d* will contact the finish element 43 with enough force to displace the tag 41 outwardly. This displace will also take place with a solely vertical movement of the cap 10, however, the user will need to exert greater force than is necessary with a threaded embodiment.

In the preferred embodiment shown in the FIG. 1, 2 and 3, tag 41 and hinge element 42 are integrally molded with cap 10. Hinge element 42 is preferably further defined by a small relief 44. Relief 44 defines a definite hinge point and provides a slight reduction in strength at that point. This reduces the necessary force to remove the closure and provides an easy check point for prior stressing. The material for cap 10 is selected such that the hinge has elastic memory which after displacement maintains its position thereby providing visual evidence that cap 10 has been removed. The molding of a hinge with an elastic memory will be known to those skilled in the art.

Figure 5:
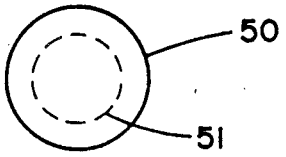
FIG. 5 is a front elevation, along the line 5—5 of FIG. 4, showing the sealing element.
Figure 6:
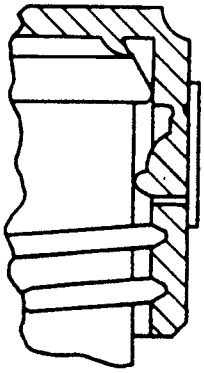
FIG. 6 is a partial cross-sectional view of the container closure of FIG. 4 showing the sealing element in position.
Figure 7:
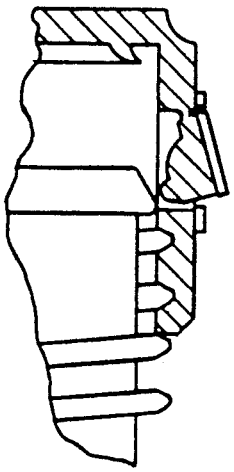
FIG. 7 is a partial cross-sectional view, similar to FIG. 3, showing a partially removed closure with a broken seal.

With reference to FIGS. 4, 5, 6 and 7 there is shown a further embodiment having sealing disk 50 applied over the tag 41 to further defined tamper indicator means 40. The sealing disk 50 may be applied with an adhesive or other suitable means. Disk 50 may be of a number of various material presently used in labels. In fact, label paper is a preferred material for disk 50. As best seen in the FIGS. 6 and 7, outward displacement of indicator means 40 will rupture the seal 50 and provide a visual indication that the cap has been displaced. Although it is preferable that the hinge member 42 have an elastic memory, it is not necessary when seal 50 is employed since visual indication of cap removal is provided by the broken seal 50. With reference to FIG. 5, it is expected that the seal 50 will have perforations 51 that complement the shape of tag 41 and aperture 6. This will facilitate displacement of the seal upon opening and will enable the use of stronger sealing materials and adhesives.

It will be recognized by one of ordinary skill in the art that the location of cap 10 upon container neck 13 is performed in a conventional manner. As one for example, the cap may be molded from plastic such that its interior dimension is slightly greater than the exterior circumference of container neck threads 18 and finish 43. Once in position the cap may be shrunk through the application of heat in a conventional manner to securely seal cap 10 to the container neck 13. Additional examples are disclosed in my prior U.S. Pat. 4,771,923 and as such are incorporated herein by references as if fully set forth.

Figure 8:
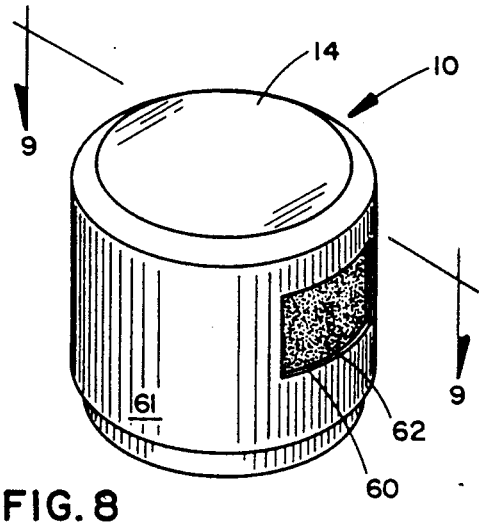
FIG. 8 is a perspective view of an alternate embodiment of the container closure of the present invention.
Figure 9:
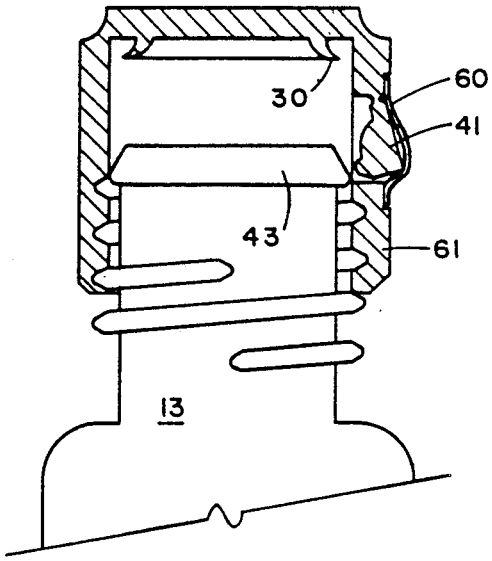
FIG. 9 is a cross-sectional view of the container closure of FIG. 8 oriented in a partially removed from a container.

With reference to FIG. 8 and 9, an alternate embodiment of the present invention is shown. Except as otherwise described, cap 10 is identical to the previous embodiment. In this embodiment, a recess 60 is defined in the exterior side wall or body 61 of the cap 10 at the same position as indicator means 40. A cover element 62 is affixed, such as through adhesive or heat, within recess 60 to substantially cover tamper indicator 40. Cover 62 is substantially flush with the exterior side wall 61 to cap 10.

As with the prior embodiment, outward displacement of the indicator 40 results from displacement of the cap 10. This displacement moves the tag 41 into interference with and results in deformation of the cover element 62. If cover element 62 is permanently deformed, hinge element 44 need not retain tag 41 in the outward disposition.

Figure 10:
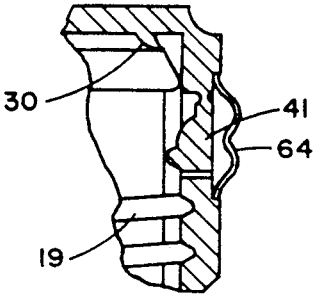
FIG. 10 is a partial cross-sectional view of the container closure illustrating an alternative embodiment.
Figure 11:
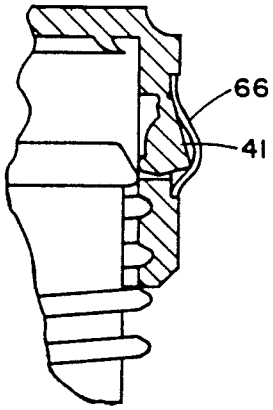
FIG. 11 is a partial cross-sectional view of an alternative embodiment of the container closure of the invention container.
Figure 12:
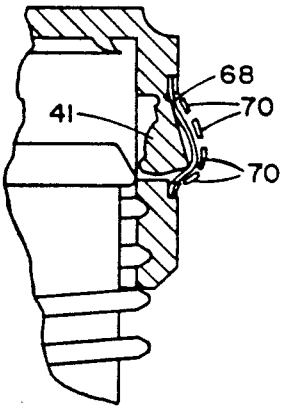
FIG. 12 is a partial cross-sectional view of an alternative embodiment of the container closure of the invention.

With reference to FIGS. 10, 11 and 12, alternative forms for cover element 62 will be discussed. As may be appreciated by those skilled in the art the use of a cover element has some additional advantages. As a first advantage, a cover element will act as a dust cover over the exposed thread area. As a second advantage, a cover element with permit greater tolerances in manufacturing and will lend itself to may variations in shape, size display, wording and/or color. Additionally, a cover element may ease the initial application of the closure to the container. Thus, the closure may be applied to the container and the cover element applied to that assembly. Such a construction technique permits greater movement of the hinged element during initial application.

With reference to FIG. 10, covering element 64 as shown here comprised of a non-rupturable material which becomes permanently deformed through the outward movement of hinged tag element 41. Since the permanent deformation of element 64 provides a visual indication of prior cap removal, tag element 41 need not maintain an outward displacement. The tag 41 is shown in its original position. If desired, covering element 64 may be a band of shrink wrap material which surrounds the cap and becomes deformed on removal of the cap.

With reference to FIG. 11, an second alternative for the covering element is shown. Here, cover 66 is a sheet of material which changes color when deformed. It will be recognized by one that is skilled in the art that such material is readily available in the form of microencapsulated color or pigment beads, which rupture when pressure is applied. Suitable materials are available from the 3M Corporation. One suitable material is that which is sometimes referred to as "scratch and sniff" and is common in the fragrance art.

With reference to FIG. 12, the covering member may comprise a multiple layer cover having a flexible interior layer 68 of a specific color, such as red, and a more rigid exterior layer 70 of a different color, such as green. In this embodiment, displacement of tag 41 fractures the outer layer 70 which exposes the interior layer 68 and indicates that the cap had been displaced. Alternatively, the exterior layer 70 may be used individually and independent of the interior layer 68. One suitable material for exterior layer is a sheet of solidified vegetable material, such as starch.

Figure 13:
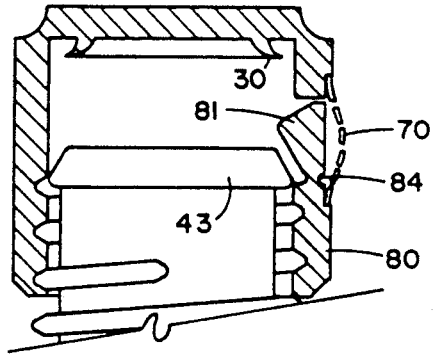
FIG. 13 is a partial cross-sectional view of an alternative embodiment.

With reference to FIG. 13, there is shown a combination of two alternative embodiments. In this embodiment, cap 10 has a side wall 80 in which the hinged tag element 81 extends vertically upward from the hinge 84. This is rotated 180° from the embodiment of FIG. 1 and serves to illustrate how the orientation may be varied. It should also be noted that the cam surface of element 81 is of a different configuration than that previously described. This serves to illustrate that the important feature of the invention is the establishment of displacement interference between the container finish and the tamper evidencing means rather than the specific geometry of that interference. FIG. 13 also illustrates the use of a single rigid layer 70 which is fractured by outward displacement of the tamper evidencing means.

The cap 10 of the present invention may be formed from a variety of known suitable plastic materials, including but not limited to materials as polyethylene, polypropylene, polystyrene or polyvinylchloride.

While the present invention has been described in terms of a number of preferred embodiments, the invention is not limited thereto and includes all modifications within the spirit and scope of the claims.

I claim:

1. A tamper evident closure for an open container having an outwardly projecting finish approximate the container opening, said closure comprising:

a hollow body which encloses the finish and has a closed end and an opened end; and tamper evidencing means disposed within said body, said tamper evidencing means which is substantially coplanar with an exterior surface of the hollow body including a hinged element which is displaced outwardly from the coplanar relationship by engagement of said hinged element with the enclosed finish during removal of the closure.

2. The closure of claim 1 further comprising means for sealing the container opening.

3. The closure of claim 1 further comprising threads within body for mately engaging a thread pattern on the container finish.

4. The closure of claim 1 wherein said hinged element has an elastic memory that maintains it outward displacement.

5. The closure according of claim 1 further comprising a seal affixed to the body exterior and overlying the tamper evidencing means whereby outward displacement of said hinged element ruptures said seal.

6. The closure of claim 1 further comprising a covering element affixed to body exterior and overlaying the tamper evidencing means, whereby outward displacement of the hinged element physically alters the covering element.

7. The closure of claim 6 wherein said covering element is a deformable material.

8. The closure of claim 7 wherein said deformable material is permanently deformed by displacement of the hinged element.

9. The closure of claim 6 wherein the physical alteration of said covering element is a visual change in color.

10. The closure of claim 6 wherein said physical alteration releases microencapsulated pigments.

11. The closure of claim 10 wherein the release of said microencapsulated pigments produces a visual change in color.

12. The closure of claim 6 wherein said covering element comprises at least a flexible interior layer, and a more rigid, frangible outer layer.

13. The closure of claim 12 wherein said flexible interior layer has a color different than that of said body.

14. The closure of claim 13 wherein said outer layer has a color different than that of said interior layer.

15. A tamper evidencing package comprising:

a container having a finished opening that includes an outwardly projecting finish element proximate to said opening; and a closure which mates with and closes said container opening, said closure further comprising:

a hollow body which encloses the finish and has a closed end and an open end; and tamper evidencing means disposed within said body, said tamper evidencing means which is substantially coplanar with an exterior surface of the hollow body including a hinged element which is displaced outwardly from the coplanar relationship by engagement with the projecting finish element enclosed by the body and is displaced outwardly by said engagement as the closure is removed from the container.

16. A tamper evidencing package comprising:

a container having a finished neck opening that includes an outwardly projecting finish element proximate to said opening and a thread pattern positioned between the projecting finish element and the container; and a closure having an open end, a closed end and a body portion, said body portion enclosing the outwardly projecting finish and having a thread pattern which complements the thread pattern of said finish and a tamper evidencing means disposed within said body, said tamper evidencing means which is substantially coplanar with an exterior surface of the body including a hinged element that engages the enclosed projecting finish element and displaces the hinged element outwardly from the exterior surface of the body as the closure unthreads during removal from the container.

17. A tamper evident closure for an open container having an outwardly projecting finish approximate the container opening, said closure comprising:

a hollow body which encloses the finish and has a closed end and an opened end; and tamper evidencing means disposed within said body, said tamper evidencing means including a hinged element which has an elastic memory and is outwardly displaced, by the required engagement of said hinged element with the finish enclosed by the body, during removal of the closure from the container and is retained on the closure in its outward displacement.

18. A tamper evident closure for an open container having an outwardly projecting finish approximate the container opening, said closure comprising:

a hollow body, which encloses the finish, having a closed end and an opened end; and tamper evidencing means disposed within said body and including a hinged element which has elastic memory and is outwardly displaced, by the engagement of said hinged element with the enclosed finish during removal of the closure from the container and is retained on the closure by reason of the elastic memory.

19. A tamper evident closure for an open container having an outwardly projecting finish approximate the container opening, said closure comprising:

a hollow body which encloses the finish and has a closed end and an open end;

tamper evidencing means disposed within said body, said tamper evidencing means including a hinged element which is displaced by engagement of said hinged element with the enclosed finish during removal of the closure; and a covering element affixed to the body exterior and overlying the tamper evidencing means, said covering element further comprising at least a flexible interior layer and a more rigid, frangible outer layer, whereby the outward displacement of the hinged element physically alters the covering element.

20. The closure of claim 19 wherein said flexible interior layer has a color different than that of said body.

21. The closure of claim 20 wherein said outer layer has a color different than that of said interior layer.

* * * * *